US005752642A

United States Patent [19]

Bucher

[11] Patent Number: 5,752,642

[45] Date of Patent: May 19, 1998

[54] THREAD CLAMPING APPARATUS

[75] Inventor: Gert Bucher, Heiningen, Germany

[73] Assignee: Saxonia Unformtechnik GmbH, Göppingen, Germany

[21] Appl. No.: 678,264

[22] Filed: Jul. 11, 1996

[30] Foreign Application Priority Data

Jul. 12, 1995 [DE] Germany ..... 195 25 434.1

[51] Int. Cl.[6] ..... B65H 20/00; B65H 20/24; B66C 23/06

[52] U.S. Cl. ..... 226/155; 112/255; 112/302; 226/110; 226/149

[58] Field of Search ..... 226/154, 155, 226/110, 149; 112/302, 254, 255

[56] References Cited

U.S. PATENT DOCUMENTS

| | | | |
|---|---|---|---|
| 3,067,704 | 12/1962 | Pedersen | 112/302 X |
| 3,334,477 | 8/1967 | Morin et al. . | |
| 3,888,401 | 6/1975 | Minall et al. | 226/155 X |
| 4,043,494 | 8/1977 | Bickford et al. | 226/154 X |
| 4,531,385 | 7/1985 | Jacobsson . | |
| 4,852,339 | 8/1989 | Premi . | |
| 5,222,989 | 6/1993 | Hyca | 226/110 X |
| 5,269,244 | 12/1993 | Cataletto | 112/302 |
| 5,297,323 | 3/1994 | Jaeggi . | |
| 5,603,462 | 2/1997 | Conrad et al. | 226/110 X |

FOREIGN PATENT DOCUMENTS

| | | |
|---|---|---|
| 934946 | 10/1973 | Canada . |
| 3336202 | 4/1985 | Germany . |
| 3935536 | 5/1991 | Germany . |
| 4344348 | 6/1995 | Germany . |

*Primary Examiner*—Michael Mansen
*Attorney, Agent, or Firm*—Evenson, McKeown, Edwards & Lenahan, PLLC

[57] ABSTRACT

An apparatus for clamping an individual thread out of a plurality of threads, which are guided in side-by-side relationship, includes a transport unit with a drivable transport shaft and a rotatable contact pressure shaft. A thread is guided between the shafts. A clamping unit with an abutment and a clamping pin acting thereagainst is used for clamping a respective thread. Between the clamping pin and one of the functional parts of the transport unit, there is an operative connection. Increasing the clamping of a thread in the clamping unit causes an increasing release of the thread in the transport unit and vice-versa. The operative connection can adopt a central position in which the thread is loose both in the transport unit and in the clamping unit.

18 Claims, 3 Drawing Sheets

THREAD CLAMPING APPARATUS

FIELD OF THE INVENTION

The invention concerns clamping, transporting or completely releasing individual threads out of a plurality of threads guided in side-by-side relationship such as yarns in a thread-processing machine.

BACKGROUND OF THE INVENTION

In the particular case of sewing or knitting machines, when changing thread, the new thread required must be pulled in by hand through the entire thread guide arrangement. This can involve a relatively large amount of preparation and resetting time, depending on the frequency with which the thread is changed.

Therefore, automatically operating thread change apparatuses are known. In such apparatuses, the threads which are available for selection, disposed in side-by-side relationship, generally terminate with their free ends at the front end of a so-called eye rack which has a separate through opening for each thread. Disposed downstream of that eye rack, in the direction of movement of the thread, there are separate apparatuses for frictional transportation by means of transport rollers for the threads as well as clamping devices for individual threads. Then, disposed immediately upstream of the thread rack, in the direction of movement of the thread, and displaceable transversely relative to the thread rack, there is a unit which is capable of automatically joining the previously used thread to the desired new thread, and then cutting off the old thread, thereby producing an automatic thread change operation. In most cases, this involves a swirl chamber which operates by means of compressed air and in which the threads, by being acted upon by compressed air, are divided up into filaments. The filaments of the two threads are then firmly woven together.

In thread change apparatuses of the kind in accordance with German patent application No P 43 44 348, separation of the thread clamping action and the thread transport in part gives rise to operational problems. This is because transportation of the threads, which must take place synchronously in a defined manner during the swirl phase for the old and the new threads, is not effected for each individual thread. Transportation is instead effected by means of friction rollers which generally extend transversely over the entire selection of threads and between which the threads are gripped and transported forwardly by driving one of the rollers.

In order to limit this situation so that it only involves further transporting the old and new threads as desired, all other threads are clamped. In the clamping device, in the direction of travel upstream of the transportation location of the thread. That however means that the clamped threads are subjected to constant friction in the transport device in which they are nonetheless engaged between the transport roller and a contact pressure roller but cannot be moved in the forward direction. Consequently, when those threads are subsequently used, a yarn breakage can occur at precisely that location. In addition the previous separate design configuration of thread transport and thread clamping is highly expensive from the mechanical point of view.

SUMMARY OF THE INVENTION

An object of the present invention is to provide a thread clamping arrangement, for particular use in a yarn change apparatus, which is simple in terms of design, assembly and maintenance and which is easy and straightforward in operation.

Another object of the invention is to provide a thread clamping apparatus which affords a thread clamping transport procedure of enhanced reliability while dealing with the threads carefully and gently.

According to the invention the foregoing and other objects are attained.

In the apparatus according to the invention, there is an operative connection between the clamping unit and the transport unit. Such a connection is preferably a mechanical operative connection in the form of a two-armed lever. That lever is pivotable between the two units about an axis and there is preferably a separate clamping unit and a separate transport unit for each individual thread. The lever or, in general terms, the operative connection is displaceable together with the threads in the transverse direction in order to move the desired new thread, or the thread to be processed, to the single processing position available. This position is generally aligned with the old and new thread-joining units such as, for example, swirl-type joining chambers.

Preferably, each of the narrow two-armed levers each associated with a respective thread is provided with a clamping projection or pin which is generally formed integrally with the one end of the lever and presses against a fixed bar-like abutment which is generally continuous over the entire width of the threads available for selection. Rotatably mounted at the other end of the lever is a contact pressure disk which, by pivotal movement of the lever about its axis, can press against a drivable transport shaft and, in so doing, can take up the thread between the contact pressure disk and the transport shaft. When the transport shaft is driven in that condition, the thread is thrust forwardly with a defined movement. In order to cause that to occur synchronously for the old thread and for the desired new thread, the transport shaft is generally designed to extend continuously over a plurality of threads or even over all the threads which are available for selection and which are guided in side-by-side relationship. The contact pressure disk for each thread is provided separately on a separate lever.

In order to provide for reliable clamping of the thread, provided in the transport shaft are annular grooves into which the contact pressure disks engage relatively tightly, that is to say with a very small spacing relative to the flanks or sides of the grooves, so that it is no longer possible for the thread to escape laterally.

The clamping unit at the other end of the operative connection or the two-armed lever also comprises a clamping projection or pin associated with each individual thread, for example the end of the two-armed lever, which is formed integrally with that lever. The clamping projection or pin press the thread against an abutment and thereby clamp it. The abutment can be of a bar-like configuration extending continuously transversely over the entire number of available threads and can be adapted to be displaceable in the transverse direction.

The operative connection is of such a configuration that upon pivotal movement into one extreme position, it clamps the corresponding thread in the clamping unit while, upon pivotal movement into the other extreme position, it presses the thread by means of the contact pressure disk against the transport shaft. In the central position, the operative connection leaves the thread loose in both units. Consequently, the desired one of the three necessary positions, that is to say transport position, clamping position or sewing position, can be set by means of the one operative unit for each thread.

When the operative connection is in the form of a two-armed lever, it is, for example, pivotable in the center about an axis on which all juxtaposed two-armed levers for each thread are mounted. If the thread extends above the two-armed lever, then the clamping pin is in the form of a projection which projects upwardly from one end of the lever and which presses the thread against an abutment extending thereover. Mounted rotatably at the other end of the lever is the contact pressure disk which can press the thread extending thereover against a transport shaft which is disposed thereabove.

In that respect, each of those operative connections, that is to say the two-armed lever, is biased towards the clamping position for example by means of a spring. However in the sewing position, in which the associated thread extends loosely, the lever is additionally held by a suitable holding element which can be brought into and out of engagement with the operative connection. It is only when that holding element is moved out of the region of the operative connection that the latter attains its clamping position. For that purpose the two-armed lever, as the operative connection, additionally has a third lever arm as an actuating arm which for example projects downwardly transversely to the horizontally extending two-armed lever. As a result, so that the free end of the actuating arm can be acted upon on the one hand by a spring while on the other hand it is pressed against the holding element.

The two-armed levers which are associated with each thread and which, for reasons of structural simplification, are disposed in side-by-side relationship are displaceable in the transverse direction together with the threads. When the transport shaft is provided with the grooves for each thread, the levers are displaceable also together with the transport shaft. The levers are displaceable in this manner in order to be able to move the respectively desired thread into the processing position which is present only once in the transverse direction. In contrast, the continuous abutment, which is in the form of a bar, can be stationary and can be non-displaceable in the transverse direction. The holding elements which hold the lever in the sewing position can also be stationary.

That holding element has to be designed separately only at the one processing position. The holding element for all other positions can be designed integrally or can be adapted to extend over a plurality of threads.

In addition, disposed in the processing position and thus being non-displaceable in the transverse direction is a functional element, for example a selection lever, which can pivot the two-armed lever against the force of the spring biasing. The lever can be pivoted, for example, from the clamping position beyond the holding element into the central position or still further into the transport position. For that purpose, the holding element disposed in the processing position is so movable that it is both in and also outside the operative region of the operative connection, that is to say for example the actuating arm of the two-armed lever. The holding elements outside the processing position are also movable in that sense, for example by longitudinal movement in the direction of transport of the thread or in the opposite direction thereto. That movement is preferably produced directly by the functional element which is arranged only in the processing position.

It is possible to achieve the three conditions which are necessary for a thread change apparatus. Hereinafter, for reasons of improved comprehensibility, instead of general terms, such as operative connection, functional element, etc, the specific designations two-armed lever, selection lever, etc will be used, without causing the invention to be restricted to that specific mechanical construction.

Other mechanical constructions can be used in equivalent fashion. Also, non-mechanical constructions such as, for example, partly electrical or pneumatic constructions, can be used.

The processing condition provides that only the thread which is in the processing position is free both in the transport unit and also in the clamping unit. Thus, only this thread can be pulled through as it is processed in the sewing, knitting etc operation. All other threads are clamped fast in the clamping unit.

The selection condition now involves changing over to a new thread, after the operation of processing an old thread, by a procedure whereby the entire thread selection together with the levers, contact pressure disks and grooved transport shaft is already displaced in the transverse direction to such an extent that the new thread is already in the processing position. Consequently, the old thread is already outside of and beside the processing position. In that situation, the old thread is free both in the clamping unit and also in the transport unit as the associated levers are held in the loose central position. All other threads are clamped in the clamping unit.

The transport condition provides that both the selected new thread and also the old thread are pressed in the transport unit against the rotatingly driven transport shaft. The threads are pressed by means of the contact pressure disks and are thereby advanced synchronously and with a defined movement by means of the transport shaft. At the unit which is further forward in the transport direction and used for joining the old thread to the new thread, for example a swirl chamber, the two threads can be joined over a defined distance. In this case also, all other threads are clamped in the clamping unit.

Further objects, features and advantages of the invention will be apparent from the following description of a preferred embodiment.

DESCRIPTION OF A PREFERRED EMBODIMENT

Figure 1:
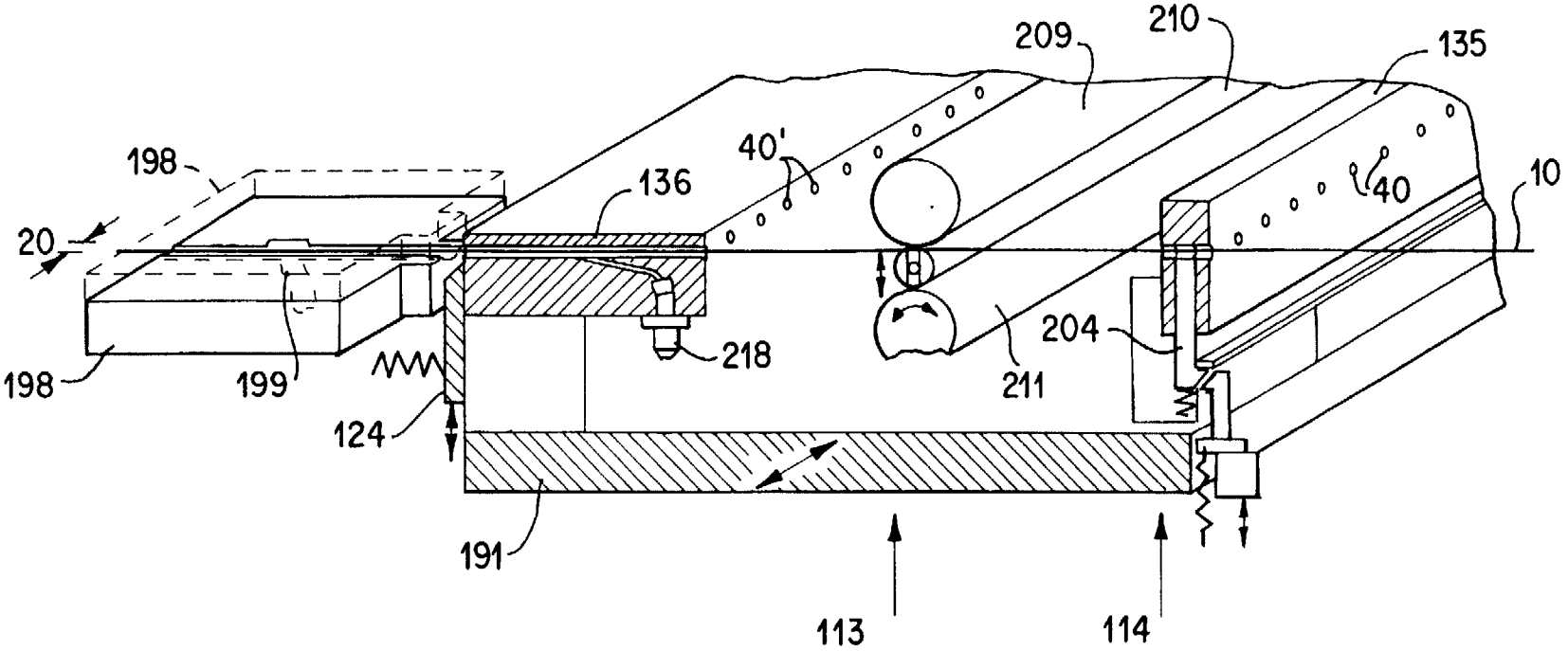
FIG. 1 PRIOR ART
FIG. 1 shows a thread change apparatus with yarn clamping in accordance with the state of the art.

Reference will first be made to FIG. 1 of the drawing.

For reasons of simplification, FIG. 1 shows only a single thread, namely the thread 10 which is disposed in the processing position 20 and which therefore also passes through the swirl chamber 198 which is always stationarily disposed in alignment with the processing position upstream of the actual thread change apparatus. In that respect, it is possible to see in the swirl chamber 198 the passage which is provided between the bottom and the top thereof and through which the thread 10 extends, and which can be acted upon with compressed air from below by way of a compressed air connection 199. If the free front end (not shown) of the new thread is also disposed in the chamber beside the old thread 10 illustrated, then the thread filaments can be caused to swirl around and thus the two threads can be fixedly joined together. In that way, the desired new thread can be drawn by means of the old thread that is no longer required, through the further thread line of movement, for example sewing needle eyes, etc, to effect automatic thread changing.

The actual thread change apparatus is disposed on a carriage 191 which is displaceable in the transverse direction. Disposed in side-by-side relationship in the eye rack 135 which is first in the direction of through movement of the threads and the second eye rack 136 are a plurality of mutually aligned eyes 40 and 40'; a respective one of the other threads available for selection which extend parallel to the illustrated thread 10 and which are not shown for reasons of clarity of the drawing extends through each of the eyes 40, 40'. The threads which are not being used at the present time terminate at the left-hand front end of the eye rack 136 where they can be cut by means of the blade 124 which acts from below.

The compressed air connection 218 in the front eye rack 136 serves, upon transverse displacement of the carriage 191, to be able to shoot the new thread which is then in the processing position, forwardly into the swirl chamber 198, by means of compressed air, in addition to the old thread. For this purpose, however, it is necessary to ensure by means of the yarn clamping action which occurs therebehind in the clamping unit 114 that that forward movement occurs at a defined speed and over an only defined length. Otherwise, the compressed air would cause the new thread to be shot much too far forwardly. This would give rise to corresponding operational difficulties.

In the configuration shown in FIG. 1, the actual yarn clamping action is achieved by virtue of the fact that, in each individual eye 40 of the first eye rack 135, a spring-loaded push rod 204 can clamp each individual thread in the associated eye 40. Independently thereof, the defined thread transport is guaranteed by virtue of the fact that the threads are possibly clamped between a transport shaft 209 and a contact pressure shaft 210 and are further transported with a defined movement by rotation of the transport shaft 209. The clamping action is produced by the contact pressure shaft 210 in turn being pressed or not pressed against the transport shaft 209 by a shaft 211 which is of a segment-like configuration.

A disadvantage in that arrangement is that, in the case of transport movement, not only the desired old and new threads but all threads are to be pressed between the transport shaft 209 and the contact pressure shaft 210 in the transport unit 113 and subjected to further transportation movement by means of frictional engagement; in the case of the other threads which are not required however, that is prevented by the clamping arrangement which involves a stronger force-locking engagement, in the rear eyes 40. As a result, when being transported between the shafts 209 and 210, those other threads are subjected to constant wear because of the friction which occurs at that location. This can result in subsequent yarn breakages.

In comparison with the clamping action and the thread transportation action which also occur separately in FIG. 1, the clamping unit 14 and the transport unit 13 in the present invention are operatively connected. This will be described with reference to the view of the arrangement in FIG. 3. The thread transport direction 11 is shown as being from left to right in FIGS. 2 and 3 while in FIG. 1 the transport direction is from right to left.

Figure 3:
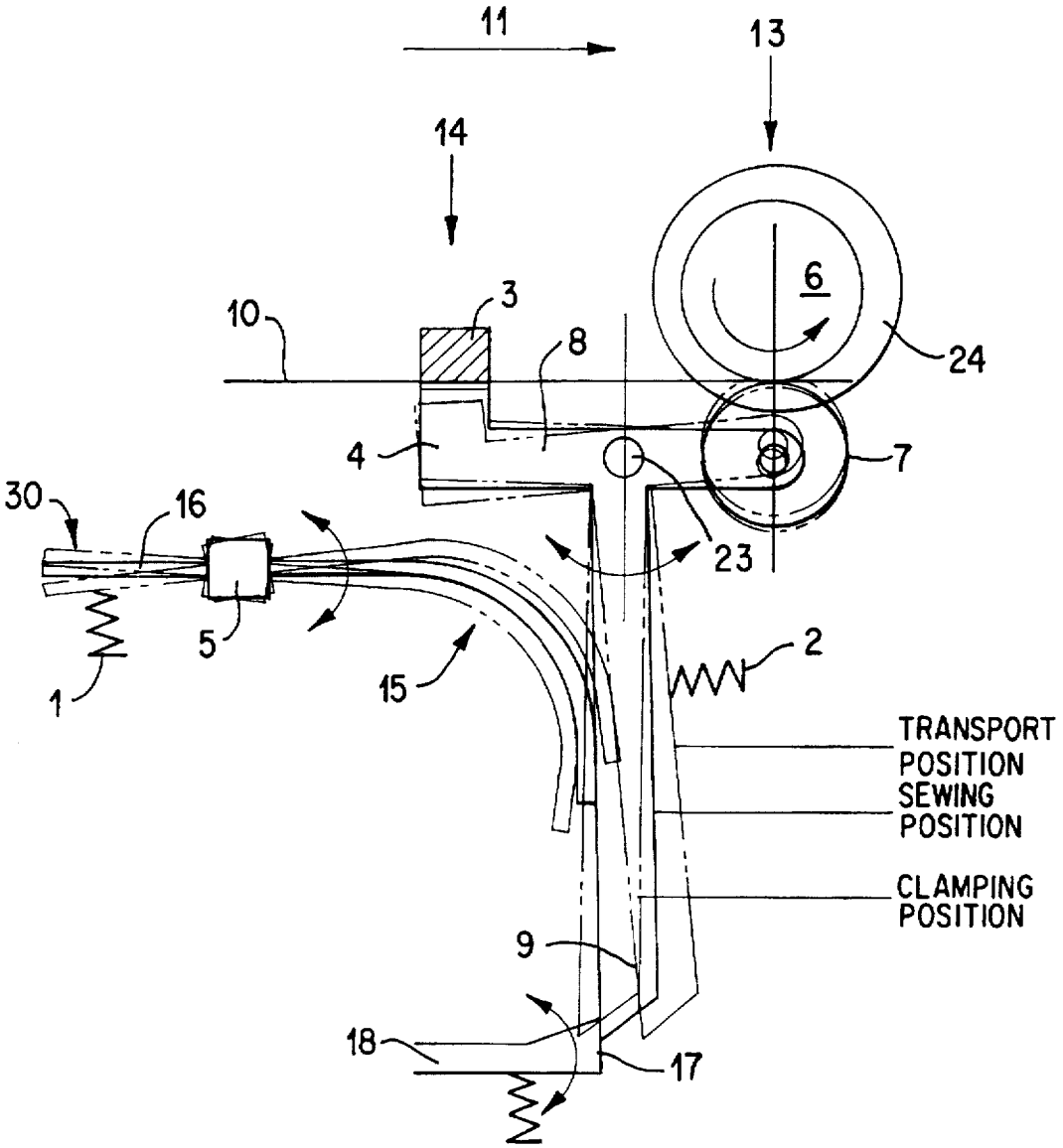
FIG. 3 is a view showing the principle of operation of the levers 8.

FIG. 3 shows a lever 8 which is pivotable about an axis 23. The lever 8 is an at least two-armed lever which is disposed substantially horizontally beneath the thread 10 and which additionally has an actuating arm 9 which projects downwardly transversely relative to those two functional arms.

From the axis 23 of the lever 8, the clamping unit 14 is disposed to the left, that is to say upstream, of the axis of the lever, and the transport unit 13 is disposed to the right, that is to say downstream, of the axis of the lever. The clamping unit 14 comprises an abutment 3 which is disposed above the thread 10 and against which the thread 10 can be pressed from below by means of a clamping projection or pin 4 and can thereby be clamped.

The clamping pin 4 is formed integrally with the one end of the two-armed lever 8 and projects upwardly in transverse relationship from that end, towards the abutment 3. A contact pressure disk 7 is rotatably mounted at the other front end of the two-armed lever 8.

The lever 8 can assume three functional positions:

In the central position, the sewing position, the lever 8 does not press the yarn 10 upwardly against the abutment 3 or the transport shaft 6 respectively, either with the clamping pin 4 in the clamping unit 14 or with the contact pressure disk 7 in the transport unit 13, so that the thread 10 is completely loose. In that situation, as illustrated, the contact pressure disk 7 can certainly already be disposed within the respective groove 24 of the transport shaft 6.

The lever 8 is held in that central position by a spring 2 urging the lever towards the clamping position, that is to say towards the left. In so doing, the spring presses the lever against a holding edge 17 which holds the lever in the central position.

From the left, the actuating arm 9 can also be engaged by a selection lever 15, which is curved in a prong-like configuration, by way of its outside curvature. The selection lever 15 can be urged into the engagement position by, for example a pneumatic cylinder (arrow 30). In this case, the force of the spring 2 which presses the actuating arm 9 against the holding edge 17 is overcome.

The lever can be pivoted from that loose central position, the sewing position by displacement of the holding plate 18 which has the holding edge 17 towards the right, or by pivotal movement of the selection lever 15 in the counter-clockwise direction. The force of the spring 2 is overcome to such an extent that the contact pressure disk 7 of the lever 8 urges the thread 10 upwwardly towards the transport shaft 6. When then the transport shaft 6 is rotated with a defined rotary movement in the counter-clockwise direction, the thread 10 is further moved in the transport direction, with a defined movement. As the clamping pin 4 moves still further away from the position which is in any case loose, opposite its abutment 3, the thread is also not clamped in the clamping unit 14. This position constitutes the transport position.

From the central position the lever 8 can also be moved towards the left into the clamping position, via pivotal movement of the actuating arm 9, by pivoting the holding plate 18 sufficiently far downwardly. As a result of this, the free end of the actuating arm 9 snaps beyond the holding edge 17 so that the clamping pin 4, by virtue of the force of the spring 2, presses upwardly against the abutment 3 and accordingly clamps the thread 10 at that location.

Figure 2:
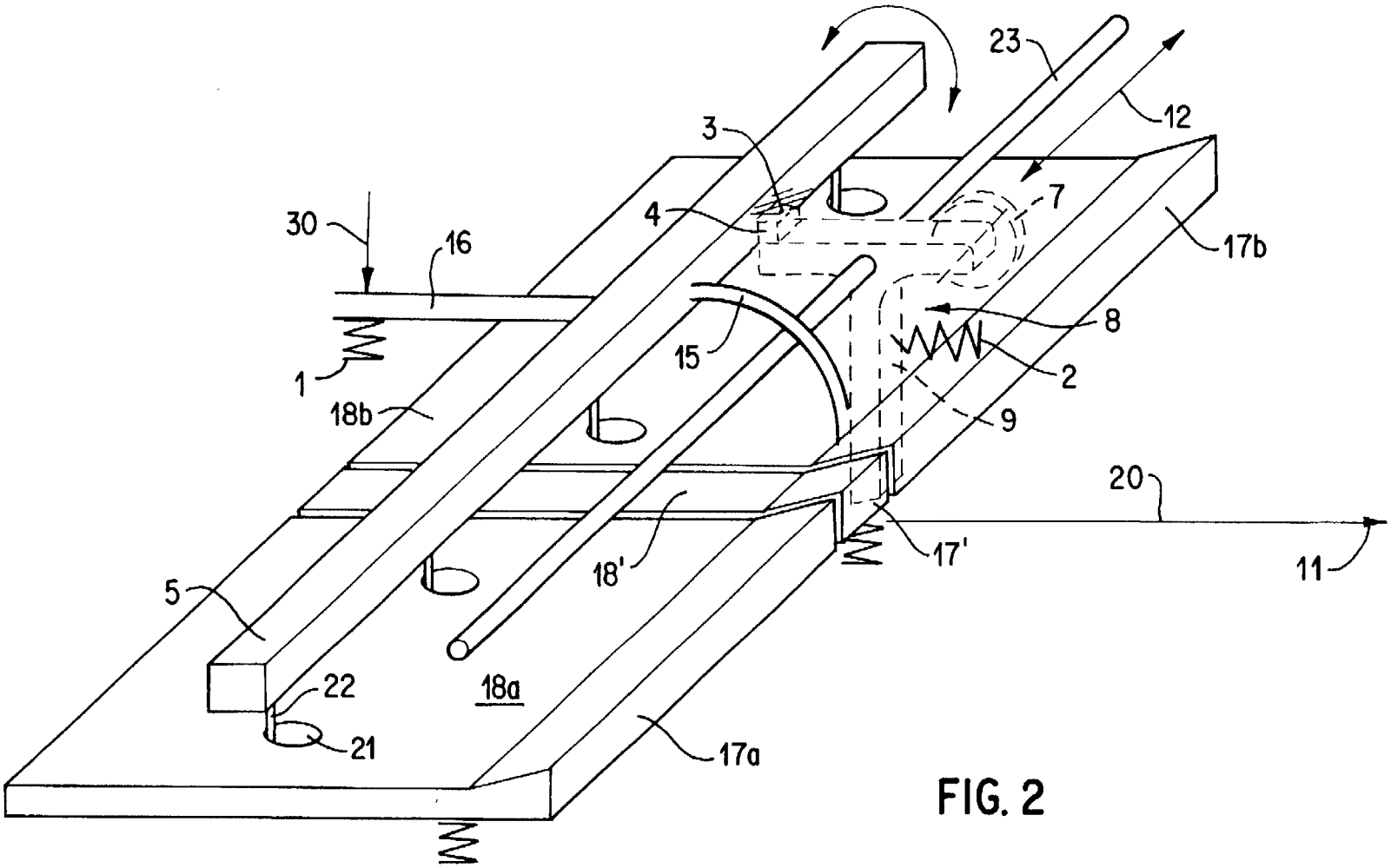
FIG. 2 is a view showing the principle of the yarn clamping arrangement according to the invention with only one single illustrated lever 8.

The yarn clamping arrangement as is shown in the perspective view showing the principle of the arrangement in FIG. 2 has a plurality of such levers 8 with contact pressure disks 7, in side-by-side relationship, for each thread 10. For reasons of clarity, FIG. 2 shows only one lever 8 and no thread. Each of the individual contact pressure disks 7 engages into an associated groove 24 in the transport shaft 6. All levers 8 are preferably mounted on a common axis 23 and are displaceable in the transverse direction 12 together with the threads, that is to say with the eye racks 135, 136 shown in FIG. 1 and for example by means of the transverse carriage 191 in FIG. 1, in such a way that the desired new thread is always in the processing position 20. When using a transport shaft 6 which has an individual groove 24 for each thread, displacement of the transport shaft 6 is also necessary if the contact pressure disks 7 are still disposed within the grooves 24 in the central position. Displacement of the abutment 3 is also desirable in order to avoid causing friction at the threads in the transverse displacement.

All transversely displaceable parts are preferably jointly fixed on a transversely displaceable carriage 191 as shown in FIG. 1.

In contrast, the selection lever 15 shown in FIG. 3 is provided only at a single position, namely the processing position 20. Likewise the holding plate 18' with the holding edge 17' is provided separately at the processing position 20 and separately in functional respects from the holding plate 18 or holding edge 17 at all other positions, for which reason those parts can also be of a unitary construction for all other positions. This is shown in FIG. 2 where a respective one-piece holding plate **18*a* and 18*b* respectively is disposed to the left and to the right of the processing position 20. At least the holding plate 18'** which is disposed in the processing position is biased from below in an upward direction and can be pressed down against that biasing force.

Preferably that is also the case for the other holding plates **18*a*, 18*b* so that, by pivotal movement of the holding edges 17*a*, 17*b* thereof in a downward direction, the actuating arms 9 can come out of engagement and can be pressed towards the left by the spring 2**.

The holding plates **18*a*, 18*b* which are outside the processing position 20 are displaceable in the transport direction 11 and in the opposite direction thereto. Displacement is caused by means of pivot arms 22 which engage into corresponding openings 21 in the holding plates 18*a*, 18*b*. The pivot arms 22 project radially from a selection bridge 5 which extends above the holding plates 18*a*, 18*b* in the transverse direction and are fixedly connected to the selection bridge 5. The selection bridge 5 is also at the same time fixedly connected to the selection lever 15 and represents its pivot axis. For pivotal movement of the selection bridge 5, at least one actuating arm 16 is arranged in radially projecting relationship thereon. The actuating arm can be urged in the direction of pressing the selection lever 15 against the actuating arm 9 of the lever 8 and is biased in the opposite direction by the spring 1**.

The top side of the holding plates 18 and, in particular, at least the holding plate 18' in the processing position 20, is in the form of an inclined plane or surface which rises towards the holding edge 17' at the end of the respective holding plate.

The mode of operation of the yarn clamping arrangement is described hereinafter.

It is assumed that, at the beginning of operation of a thread-processing machine, the first thread to be processed, after that thread for example as indicated at 10 has been moved into the processing position 20 by transverse displacement, is manually inserted into the thread-processing machine. Thereafter, the levers 8 associated with all threads, for example also the thread to be processed in the processing position 20, are to be in the clamping position.

In order to be able to begin processing the new thread, that thread and the lever 8 associated with the thread must be moved into the processing position 20, and into the central or sewing position, respectively, so that the thread 10 can be caused to pass freely through the assembly as it is processed. All other threads are to be clamped in the clamping unit 4 and, therefore, the associated other levers 8 remain in the clamping position.

By actuation of the actuating arm 16 and thus pivotal movement of the selection bridge 5 and the selection lever 15, the free end of the actuating arm 9 of the lever 8 in the position 20 is displaced beyond the inclined surface of the holding plate 18' so that that lever 8 is held in the sewing position behind the holding edge 17'. That continues as long as that thread **10*a*** is being processed.

If the arrangement is to make the transition from processing that old thread 10 to processing a new thread 10, then the transverse carriage 191, which is only shown in FIG. 1 and to which the levers 8 and possibly also the transport shaft 6 but not the selection lever 15 which is stationary in the transverse direction 12 and the holding plates 18', **18*a*, 18*b* are connected, is displaced in such a way that the new thread is in the processing position 20**.

The old thread 10 still passes through the swirl chamber 198. However, downstream of the swirl chamber, the old thread goes transversely to its nozzle 40' which is outside the processing position 20. In that transverse displacement, the lever 8 which is associated with the old thread and which was in the central sewing position is transversely displaced.

As the holding edge 17 extends substantially over the entire transverse extent, in the transverse displacement, the lever 8 still remains in the central sewing position and still bears against the stationary holding edge 17. After the movement out of the processing position 20, however, the holding edge involved is not the holding edge 17' of the holding plate 18' but, for example, the holding edge **17*b* of the holding plate 18*b***.

After termination of the transverse displacement, which also involves the continuous abutment 3 which should also be connected to the carriage 191, the lever 8 which is associated with the new thread 10 and which is now in the processing position 20 must still be displaced out of its clamping position. At the same time, for the purposes of introducing the front end of the new thread 10 into the swirl chamber 198 and for joining the two threads together by a swirl action over a defined length, the old and the new threads must be transported forwardly over a defined length and at a defined speed. All other threads are to remain clamped. For that purpose, therefore, as shown in FIG. 2, the selection bridge 5 is pivoted in the counter-clockwise direction by means of its actuating arm 16.

As a result, the selection lever 15 first urges the lever 8, which is in the processing position 20, and, therefore its actuating arm 9 towards the right beyond the holding edge 17'. Upon further pivotal movement, the selection lever displaces the lever 8 until the lever 8 is in the transport position. So that, at the same time, the lever of the old thread, which is not in the processing position 20, can also be moved into the transport position, the holding plates **18*a*, 18*b* are displaced towards the right by virtue of the pivotal movement of the selection bridge 5 and the pivot arms 22 thereof. This displacement continues until the single further lever 8, namely that of the old thread, whose actuating arm 9 is still in a condition of abutting against the holding edge 17*a*, 17*b*, is pivoted towards the right so that that lever 8** also adopts the transport position.

In that position, the desired transportation movement of the old and the new threads can be produced by driving the transport shaft 6. All other threads are clamped as their actuating arms 9 of the levers 8 are in the clamping position to the left of the holding edges 17 as shown in FIG. 3.

In order then to release only the thread which is now in the processing position 20 and in order again to clamp all other threads, including the previous old thread (after the old thread has been cut off by means of the blade in FIG. 1), the holding plates 18*a*, 18*b* must be brought out of engagement. With the lever 8 still associated with the previous old thread so that it can also move into the clamping position.

Preferably, for that purpose, the holding plate 18*a*, 18*b* is pivoted in such a way that its holding edge 17*a*, 17*b* moves downwardly below the free lower end of the holding arm 9 so that the free end of the corresponding actuating arm 9 slides towards the left beyond the holding edge 17 and is pressed against the abutment 3 by the force of the spring 2, like all other levers 8 besides the lever which is in the processing position 20. It is also possible to envisage a sufficiently large displacement of the holding plate 18*a*, 18*b* towards the left.

Accordingly, the arrangement has again reached the sewing position in which it is exclusively the thread 10 that is in the processing position 20. This thread 10 passes both through the transport unit and also through the clamping unit loosely and without friction, while all other threads are clamped. The holding plate 18' which is in the processing position 20, does not perform the pivotal movement of the other holding plates 18*a*, 18*b*. Pivotal movement of the holding plates 18*a*, 18*b* can be produced by pivotal motion of the selection bridge 5 and actuating elements (not shown) which project therefrom by removing the force as indicated at 30 for actuating the actuating arm 16 of the selection bridge 5.

It will be appreciated that the above-described apparatus has been set forth solely by way of example and illustration of the principles of the present invention and that various modifications and alterations may be made therein without thereby departing from the spirit and scope of the invention.

What is claimed is:

1. An apparatus for selective clamping and transportation of at least one individual thread out of a plurality of threads which are guided in side-by-side relationship comprising:

a transport unit which includes at least one drivable transport shaft extending over said threads and a rotatable contact pressure disk, said at least one individual thread being guided between the transport shaft and the contact pressure disk; and a clamping unit which includes at least one pivotable two-armed lever defining at least one abutment and a clamping portion acting thereagainst for clamping said at least one individual thread therebetween, said at least one pivotable two-armed lever having a first end, at which the contact pressure disk is arranged, and a second end, at which the clamping portion is arranged, said lever taking a central position so that said thread is loose both in the transport unit and in the clamping unit.

2. The apparatus according to claim 1 and further comprising additional two-armed levers provided separately for other individual threads.

3. The apparatus according to claim 1 wherein said at least one two-armed lever is displaceable in a transverse direction so that each of the threads can be moved into a processing position, said two-armed lever being pivotable at least into first and second limit positions and said central position.

4. The apparatus according to claim 3 wherein the clamping portion is a clamping pin provided by the first end of the two-armed lever.

5. The apparatus according to claim 3 and further comprising a holding plate including a holding edge and an actuating arm, defined on said two-armed lever, having a free end adapted to be held by detent engagement behind the holding edge in the central position, the holding edge being movable into a position for releasing the actuating arm of the lever.

6. The apparatus according to claim 5 wherein the holding edge, in the processing position, is formed as a separate holding edge and is adapted to be separately moved into the position for releasing the actuating arm of the lever.

7. The apparatus according to claim 5 and further comprising a selection lever which moves the actuating arm defined on the two-armed lever from the clamping position into the first and second limit positions.

8. The apparatus according to claim 7 and further comprising a selection bridge which extends in a transverse direction and carries the selection lever, means for producing pivotal movement of the selection bridge about a transverse axis extending in the transverse direction, and means for biasing the selection bridge into a position bringing the selection lever out of contact with the actuating arm.

9. The apparatus according to claim 5 and further comprising at least one transversely extending holding plate arranged on each side of the processing position, each holding plate having an end face providing an additional holding edge and spring means for biasing the holding plate.

10. The apparatus according to claim 9 wherein the holding plate has a top side facing the two-armed lever and which rises towards the holding edge.

11. The apparatus according to claim 9 wherein the free end of the actuating arm projects only slightly beyond the holding edge and each holding plate is displaceable, the actuating arm being slideable beyond the holding edge.

12. The apparatus according to claim 11 wherein each holding plate is pivotable.

13. The apparatus according to claim 11 wherein movement of each holding plate is produced by the selection bridge.

14. The apparatus according to claim 9 wherein each transversely extending holding plate has openings which face the selection bridge, and further comprising pivot arms projecting radially from the selection bridge which are engageable in said openings.

15. The apparatus according to claim 14 wherein the openings are so positioned and dimensioned that the pivot arms which project from the selection bridge bear against edges of the openings which are opposite to the transport direction when the holding edge of the holding plate holds the two-armed lever in the central position.

16. The apparatus according to claim 1 and further comprising, for each individual thread, a separate contact pressure disk adapted to press each individual thread against the transport shaft.

17. The apparatus according to claim 1 and further comprising means for biasing said at least one two-armed lever for clamping within the clamping unit.

18. The apparatus according to claim 1 wherein the transport shaft has annular grooves spaced along its longitudinal extent, for each individual thread, into which grooves the respective contact pressure disks can engage with an accurate fit and with a small lateral spacing relative to respective flanks of the grooves to press the thread against the bottom of the groove, and means for displacing the transport shaft in the transverse direction with the levers and the threads.

* * * * *